United States Patent [19]

Hattori et al.

[11] Patent Number: 5,062,778

[45] Date of Patent: Nov. 5, 1991

[54] HELICAL BLADE TYPE COMPRESSOR WITH THRUST LOSS COMPENSATION

[75] Inventors: Hitoshi Hattori, Yokohama; Hirotsugu Sakata, Chigasaki; Makoto Hayano, Tokyo; Masayuki Okuda, Kawasaki; Naoya Morozumi, Machida, all of Japan

[73] Assignee: Kabushiki Kaisha Toshiba, Kawasaki, Japan

[21] Appl. No.: 657,958

[22] Filed: Feb. 21, 1991

Related U.S. Application Data

[63] Continuation of Ser. No. 388,634, Aug. 2, 1989, abandoned.

[30] Foreign Application Priority Data

Oct. 31, 1988 [JP] Japan ..... 63-275574

[51] Int. Cl.[5] ..... F04C 15/00

[52] U.S. Cl. ..... 418/220; 417/356; 415/101

[58] Field of Search ..... 418/202, 203, 220, 187, 418/188; 417/356; 415/101, 102, 103, 99

[56] References Cited

U.S. PATENT DOCUMENTS

| | | | |
|---|---|---|---|
| 1,600,440 | 9/1926 | White | 415/99 |
| 2,401,189 | 5/1944 | Quiroz | 418/220 |
| 3,804,565 | 4/1974 | Sennet et al. | 415/99 |
| 4,871,304 | 10/1989 | Iida et al. | 418/220 |

*Primary Examiner*—Richard A. Bertsch
*Assistant Examiner*—David W. Scheuermann
*Attorney, Agent, or Firm*—Cushman, Darby & Cushman

[57] ABSTRACT

A piston is eccentrically arranged in a cylinder along its axial direction and can be rotated relative to the cylinder. Part of the piston is in contact with the cylinder's inner surface. First and second helical grooves are formed in the piston's outer surface and separated at its central portion, the pitches of the grooves being gradually increased from both end portions to the center portion of the piston. First and second blades are inserted in first and second grooves so as to be moved in and out of the grooves with the outer edges of the blades contacting the inner surface. The blades partition a space between the cylinder and the piston into a plurality of operation chambers with volumes corresponding to the gradual pitch increases.

16 Claims, 8 Drawing Sheets

(ROTATION ANGLE 0°)

(ROTATION ANGLE 90°)

(ROTATION ANGLE 270°)

(ROTATION ANGLE 0°)

(ROTATION ANGLE 90°)

(ROTATION ANGLE 180°)

(ROTATION ANGLE 270°)

(ROTATION ANGLE 0°)

(ROTATION ANGLE 90°)

(ROTATION ANGLE 180°)

(ROTATION ANGLE 270°)

HELICAL BLADE TYPE COMPRESSOR WITH THRUST LOSS COMPENSATION

This is a continuation of application Ser. No. 07/388,634, filed on Aug. 2, 1989, which was abandoned upon the filing hereof.

BACKGROUND OF THE INVENTION

1. Field of the Invention

This invention generally relates to a fluid compressor and, more particularly, to a helical blade type compressor for compressing a fluid such as a refrigerant gas in a refrigeration cycle, for example.

2. Description of the Related Art

A helical blade type compressor is one of closed compressors. A compressor of this type utilizes the principle of a fluid supply screw pump disclosed in U.S. Pat. No. 2,401,189. Such a compressor is disclosed in U.S. Pat. No. 4,871,304 assigned to the present assignee.

FIG. 10 shows a main part of a conventional helical blade type compressor as disclosed in the above application. This compressor is mainly constituted by a cylinder 1, a piston 2 which rotates relative to the cylinder 1 (eccentric rotational motion), and a blade 4 inserted in a groove 3 which is helically formed in the outer surface of the piston 2, as shown in FIG. 11. As the piston 2 rotates relative to the cylinder 1, the blade 4 slides in the helical groove 3. At this time, part of the blade 4 moves in and out of the groove 3 in a direction perpendicular to the axis the cylinder 1, and hence each top portion of the blade 4 is sequentially brought into contact with the inner wall of the cylinder 1. Both the ends of the cylinder 1 and the piston 2 are rotatably supported by bearings 5 and 6. Suction and discharge ports 7 and 8 are respectively formed in the bearings 5 and 6. The pitch of the helical groove 3 is gradually decreased from the suction port 7 to the discharge port 8.

An operation of the compressor will be described below. When relative rotational motion of the cylinder 1 and the piston 2 is started, a fluid to be compressed is drawn into a space (to be referred to as an operation chamber) between the cylinder 1 and the piston 2 through the suction port 7. Since the operation chamber is partitioned by the blade 4, the fluid is compressed. More specifically, as the operation chamber moves to the discharge port 8 side upon rotational motion of the piston 2 relative to the cylinder 1, since the pitch of the helical groove 3 is gradually decreased, the volume of the operation chamber is gradually decreased. Therefore, the fluid drawn in the operation chamber is gradually compressed and is finally discharged from the discharge portion 8.

In a compressor having such an arrangement, however, a thrust F due to a differential pressure always acts in a direction from the discharge port 8 side to the suction port 7 side. This thrust F causes a loss (to be referred to as a thrust loss) of the compressor.

In addition, since the pitch of the helical groove 3 formed in the outer surface of the piston 2 is gradually changed, large deformation/distortion of the blade 4 inserted in the groove 3 is generated. The deformation/distortion increases a slide loss caused when the blade 4 moves in and out of the groove 3, and makes the blade 4 to be susceptible to damage, resulting in a decrease in reliability.

As described above, in the conventional helical blade type compressor, a thrust loss due to the difference in pressure between the suction port side and the discharge port side and a slide loss due to deformation/distortion of the blade are increased, and the reliability is decreased.

Such problems lead to a decrease in efficiency as a compressor and in reliability. These problems adversely affect the compressor, especially, in terms of efficiency. For example, in a compact compressor receiving a low input of about 100 W, the above-described thrust corresponds to about 30 kg, and a thrust loss consumes 10 W of the input.

SUMMARY OF THE INVENTION

It is, therefore, an object of the present invention to provide a new and improved helical blade type compressor which can realize high efficiency and high reliability by effectively decreasing a thrust loss and a slide loss.

According to one aspect of the present invention, there is provided a helical blade type compressor comprising:

a cylinder;

a piston eccentrically arranged in the cylinder along an axial direction thereof so as to be rotated relative to the cylinder while a part of the piston is in contact with an inner surface of the cylinder, the piston having first and second helical grooves formed in an outer surface thereof and separated at a central portion thereof, pitches of the first and second helical grooves being gradually increased from both end portions to the central portion of the piston;

first and second blades, respectively inserted in the first and second helical grooves of the piston so as to be moved in and out of the grooves and having outer edges helically brought into contact with the inner surface of the cylinder, for partitioning a space between the inner surface of the cylinder and the outer surface of the piston into a plurality of operation chambers, volumes of the plurality of operation chambers corresponding to the gradual pitch increase;

fluid introducing means for introducing a fluid to be compressed into a large-volume operation chamber of the plurality of operation chambers, which corresponds to the central portion of the piston;

driving means for causing the fluid introduced into the large-volume operation chamber to branch into the operation chambers constituting two channels whose volumes are gradually decreased toward both the end portions of the piston and sequentially supplying the fluid by rotating the piston relative to the cylinder; and fluid extracting means for extracting a compressed fluid obtained by causing the fluid to branch into the operation chambers of the two channels and sequentially supplying the fluid.

In order to achieve the above object, according to another aspect of the present invention, the pitch of a helical groove formed in the outer surface of a cylinder is gradually increased from both the ends to a central portion along the longitudinal direction of a piston, a suction port for a fluid to be compressed is caused to communicate with a space (operation chamber) partitioned by a blade between the cylinder and the piston at the central portion along the longitudinal direction of the cylinder and the piston, and discharge ports for the compressed fluid are caused to communicate with the space at both the ends along the longitudinal direction, or the pitch of a helical groove formed in the outer surface of a cylinder is gradually decreased from both the ends to a central portion along the longitudinal direction of a piston, suction ports are caused to communicate with a space partitioned by a blade between the cylinder and the piston at both the ends along the longitudinal direction of the cylinder and the piston, and a discharge port is caused to communicate with the space at the central portion along the longitudinal direction.

In addition, the blade may be formed to be symmetrical along the longitudinal direction of the piston, but is preferably inserted in the helical groove in such a manner that end portions of the blade on the suction sides are offset in the circumferential direction in the piston.

In the compressor having the above-described arrangement, thrusts generated in the operation chambers on the right and left sides along the longitudinal direction of the cylinder and the piston act in directions from both the ends to the central portion along the longitudinal direction or directions from the central portion to both the ends. Since these thrusts have substantially the same magnitude and opposite directions, they cancel each other, and the thrust loss is decreased.

In addition, since the fluid to be compressed is drawn into the right and left operation chambers upon branching, only a small pitch of the helical groove is required on each suction port side to obtain a predetermined discharge volume. This can be lead to a decrease in deformation/distortion occurring in the blade, and hence a decrease in slide loss. Therefore, the reliability is further increased.

Moreover, if the blade is inserted in the helical groove with its right and left ends on the suction port sides being offset in the circumferential direction of the piston, since variations in volume of the operation chambers at the ends of the suction port sides are reduced, a fluid to be compressed is smoothly drawn to increase volumetric efficiency, and pulsation of a discharged fluid is suppressed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Figure 1:
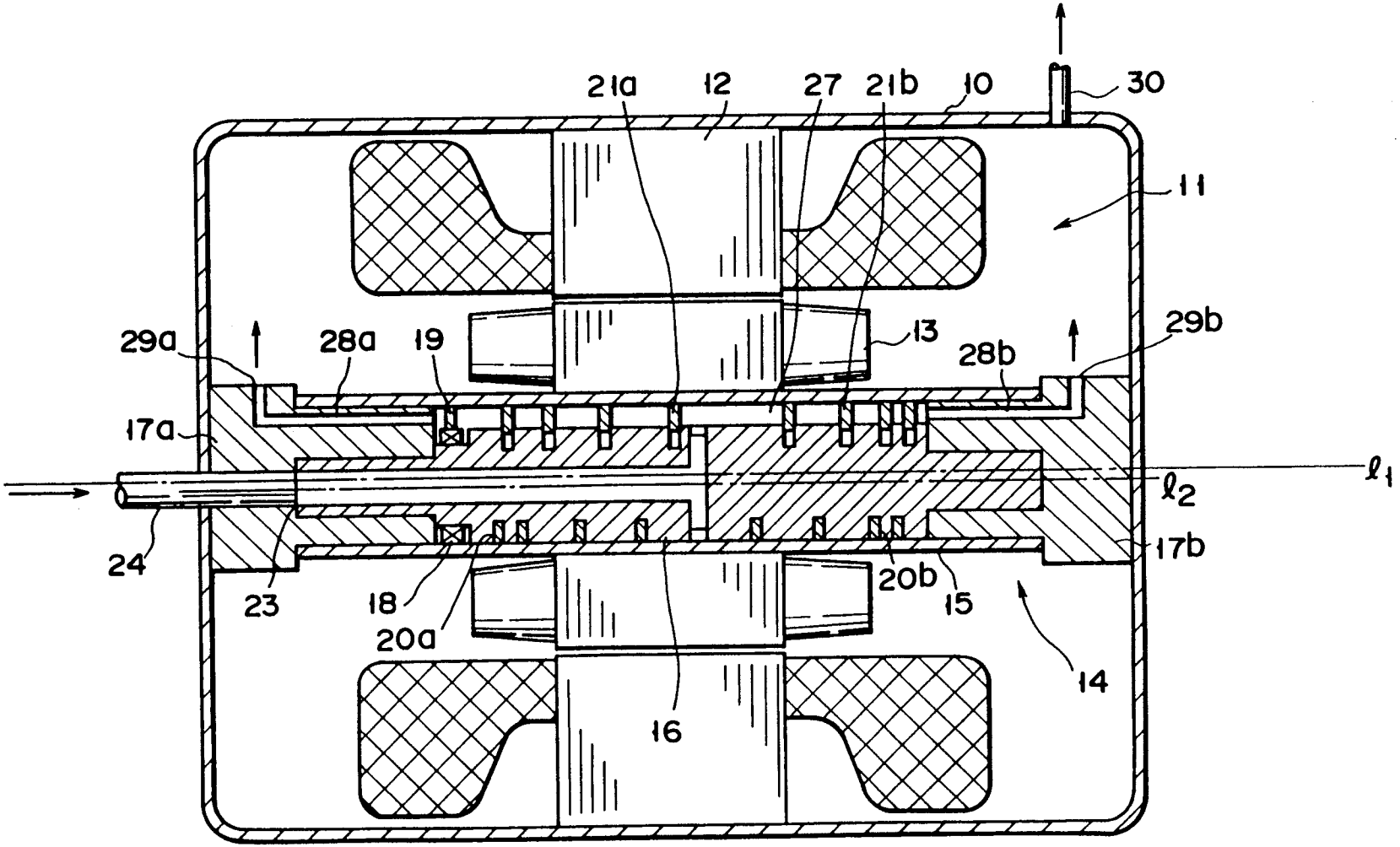
FIG. 1 is a sectional view showing a compressor according to a first embodiment of the present invention.

Preferred embodiments of the present invention will be described below with reference to the accompanying drawings.

Reference will now be made in detail to the presently preferred embodiments of the invention as illustrated in the accompanying drawings, in which like reference characters designate like or corresponding parts throughout the several drawings.

FIG. 1 is a sectional view showing a compressor according to a first embodiment of the present invention. As shown in FIG. 1, a sealed case 10 houses a stator 12 fixed to the inner wall thereof, a motor section 11 constituted by a rotor 13 arranged inward from the stator 12, and a compressing section 14 which is driven at, e.g., 3,000 to 3,600 rpm by the motor section 11.

The compressing section 14 is mainly constituted by a cylinder 15, a substantially columnar piston 16 eccentrically arranged in the cylinder 15, and a pair of bearings 17*a* and 17*b* fixed to the inner wall of the case 10 so as to oppose each other. The bearings 17*a* and 17*b* have cylindrical portions Both the ends of the cylinder 15 are fitted on the outer surfaces of the cylindrical portions The intermediate portion of the cylinder 15 is fixed to the rotor 13. In addition, both the ends of the piston 16 are respectively fitted inside the cylindrical portions of the bearings 17*a* and 17*b*. In this case, a rotational axis l2 of the piston 16 is shifted from a rotational axis l1 of the cylinder 15 by a predetermined amount.

An Oldham's ring 18 is fitted on a portion near the end of the piston 16 on the bearing 17*a* side. An Oldham's pin 19 fixed on the inner surface of the cylinder 15 is inserted in the Oldham's ring 18 so as to restrict rotation of the cylinder 15. Therefore, when the cylinder 15 is rotated by the motor section 11, the piston 16 rotates relative to and in rolling contact with the inner surface of the cylinder 15. In this case, since the piston 16 does not rotate on its own axis, the rotational speeds of the cylinder 15 and the piston 16 coincide with each other.

Figure 2:
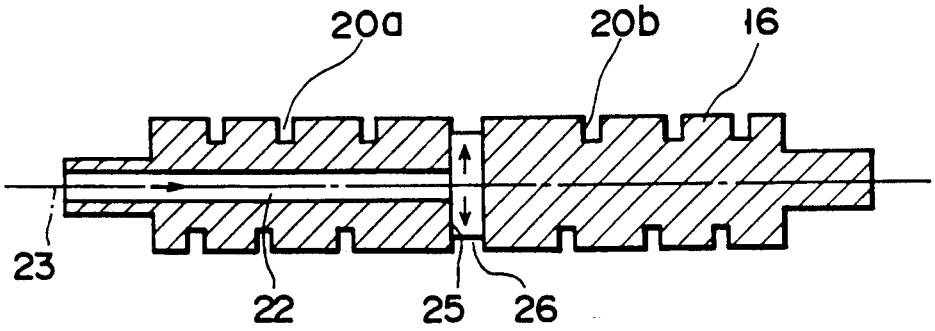
FIG. 2 is a sectional view showing a piston section of the first embodiment.

As shown in FIG. 2, helical grooves 20*a* and 20*b* are respectively formed in the left and right halves of the outer surface of the piston 16 in such a manner that their pitches are gradually increased from both the ends to the central portion along the longitudinal direction of the piston 16. Helical blades 21*a* and 21*b* as left and right halves are inserted in the helical grooves 20*a* and 20*b*. The blades 21*a* and 21*b* are made of, e.g., a fluorine plastic material having excellent wear resistance, elasticity, and sliding properties. The outer edges of the blades 21*a* and 21*b* are in rolling contact with the inner surface of the cylinder 15. The blades 21*a* and 21*b* are designed to be rotated together with the piston 16 and be moved up and down in sliding contact with the helical grooves 20*a* and 20*b* upon rotation of the piston 16.

A hollow portion 22 is formed in the left half of the piston 16. A suction port 23 is formed at one end of the hollow portion 22 on the bearing 17*a* side. The suction port 23 communicates with a suction pipe 24 inserted in the bearing 17*a*. The other end of the hollow portion 22 communicates with a space (operation chamber) 27 between the cylinder 15 and the piston 16 through a suction opening 25 and a groove 26 which are formed in the central portion of the outer surface of the piston 16. Both the end portions along the longitudinal direction of the operation chamber 27 respectively communicate with hollow portions 28*a* and 28*b* which are respectively formed in the bearings 17*a* and 17*b*. The distal ends of the hollow portions 28*a* and 28*b* respectively constitute discharge ports 29*a* and 29*b*, and communicate with the sealed case 10. A discharge pipe 30 is connected to the sealed case 10.

As shown in FIG. 2, in this embodiment, the helical grooves 20*a* and 20*b* are 180° out of phase in the longitudinal direction. That is, the end portions of the blades 21*a* and 21*b* on the suction port 23 side (the central portion in the case) are shifted from each other in the circumferential direction of the piston 16 by about 180°.

Figure 3A:
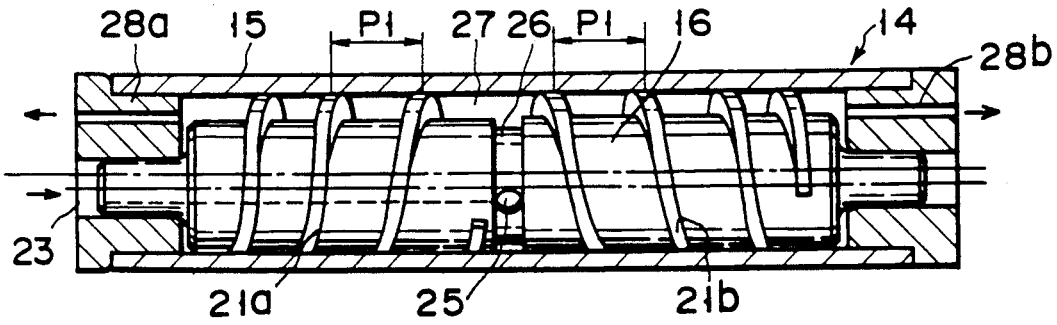
FIGS. 3A to 3D are sectional views showing an operation process of a compressing section of the first embodiment.
Figure 3B:
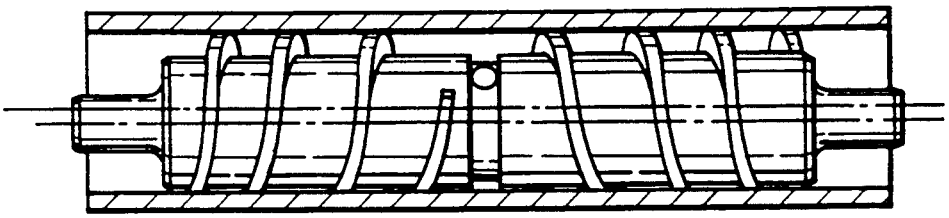
Figure 3C:
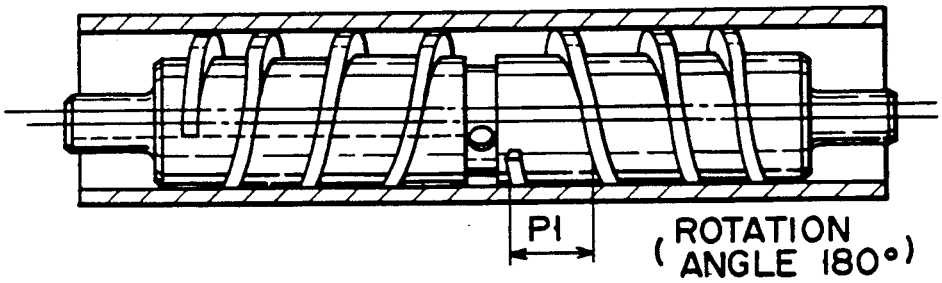
Figure 3D:
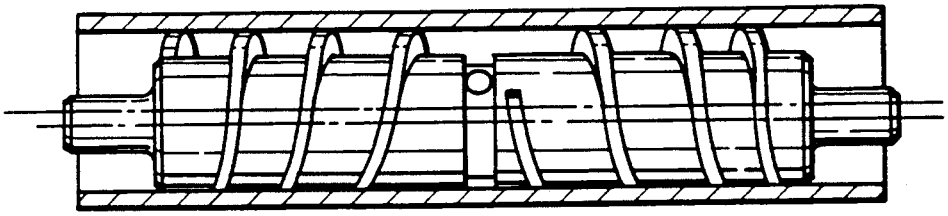
Figure 3D:
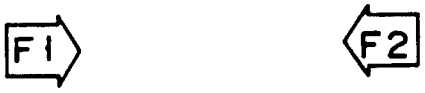
Figure 5A:
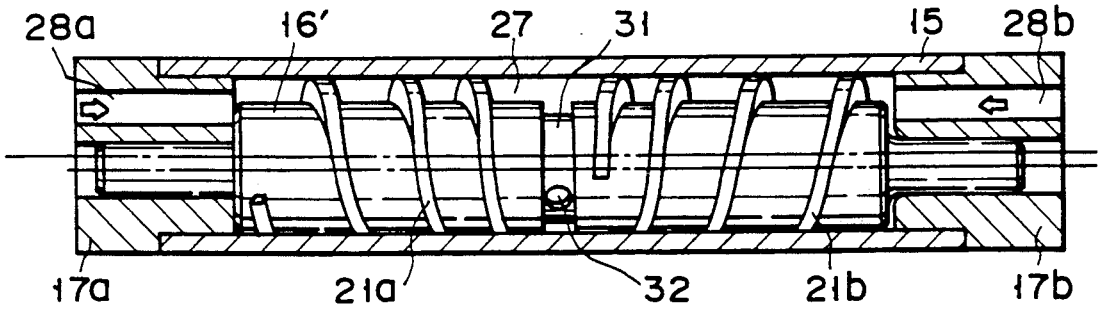
FIGS. 5A to 5D are sectional views showing an operation process of a compressing section of the section embodiment.
Figure 5B:
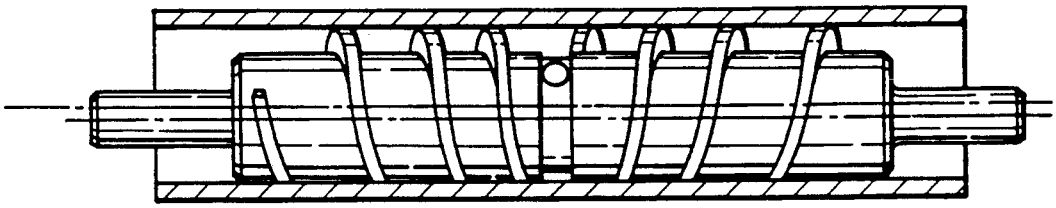
Figure 5C:
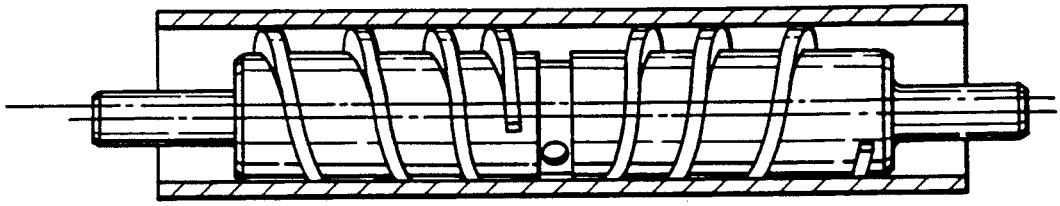
Figure 5D:
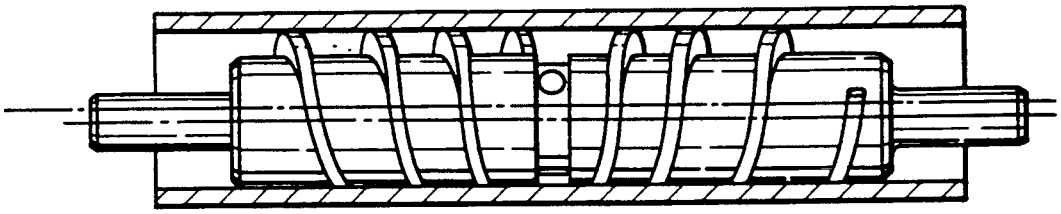
Figure 5D:
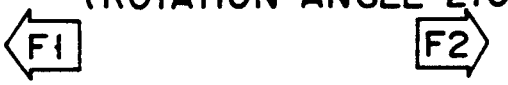

FIGS. 3A to 3D show an operation of the compressing section 14. FIG. 3A shows a state wherein the cylinder 15 and the piston 16 are located at a predetermined position (a rotation angle of 0°). FIGS. 3B to 3D respectively show states wherein the cylinder 15 and the piston 16 are rotated through 90°, 180°, and 270° with respect to the state shown in FIG. 3A. As is apparent from FIGS. 3A to 3D, a fluid to be compressed which is supplied from the suction port 23 into the operation chamber 27 through the suction opening 25 and the groove 26 at the central portion is gradually compressed as the volume of the operation chamber 27 is gradually decreased toward the right and left ends upon rotation of the piston 16 relative to the cylinder 15. Thereafter, the compressed fluid is discharged from the discharge ports 29*a* and 29*b* into the sealed case 10 (see solid arrows in FIG. 1). In this case, a gage pressure of 5.4 to 21.08 psi can be obtained as a discharge pressure.

In this case, the pressure in the operation chamber 27 becomes minimum at the central portion communicating with the suction port 23 and maximum at both the ends communicating with suction ports 29*a* and 29*b*. For this reason, thrusts F1 and F2 having substantially the same magnitude and opposite directions act on the left and right sides of the cylinder 15 and the piston 16 from both the ends to the central portion along the longitudinal direction. Therefore, these thrusts cancel each other to greatly decrease a thrust loss which causes a decrease in efficiency of a compressor of this type.

Figure 10:
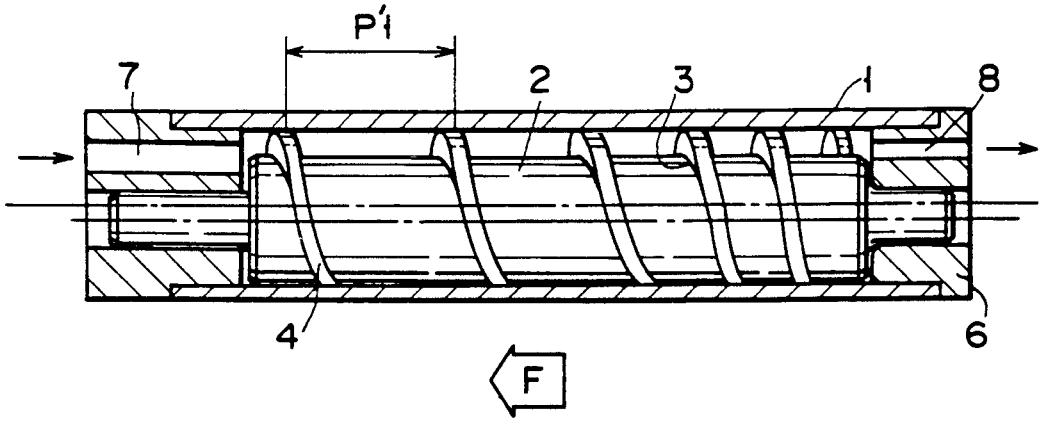
(PRIOR ART) FIG. 10
FIG. 10 is a sectional view showing a main part of a conventional helical blade type compressor.
Figure 11:
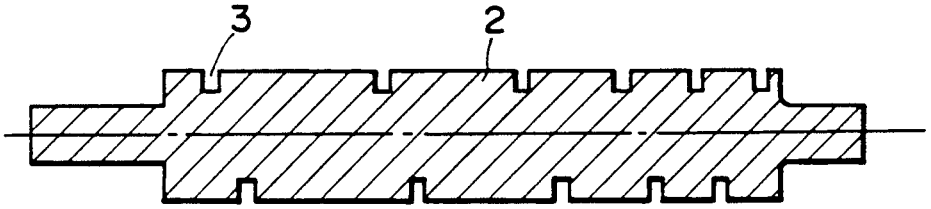
(PRIOR ART) FIG. 11
FIG. 11 is a sectional view showing a piston section in FIG. 10.

In a compressor of this type, a discharge volume is determined by the volume of a portion partitioned by the end portions of the operation chamber 27 on the suction side, i.e., the pitch of the first turn of the left and right grooves 20*a* and 20*b* constituting the helical groove on the suction side. In the conventional compressor shown in FIGS. 10 and 11, in order to obtain a predetermined discharge volume, a pitch P1′ of the first turn of the helical groove 3 must be set to a considerably large value, thus generating large deformation/distortion in the blade 4. In contrast to this, in the present embodiment, since a fluid to be compressed which is drawn from the suction port 23 is separately supplied to the right and left portions of the operation chamber 27, if the same discharge volume is obtained, a pitch P1 of the first turn of the helical grooves 20*a* and 20*b* on the suction port 23 side can be set to be ½ the pitch P1′ (see FIG. 3A). Therefore, deformation/distortion generated in the blades 21*a* and 21*b* is reduced, and the slide loss is reduced in addition to an increase in reliability.

If the blades 21*a* and 21*b* are respectively inserted in the helical grooves 20*a* and 20*b* such that the left and right end portions of the blades 21*a* and 21*b* on the suction port 23 side are shifted from each other in the circumferential direction of the piston 16 as in the embodiment, variations in volume of the end portion of the operation chamber 27 on the suction port 23 side are reduced. As a result, a fluid to be compressed is smoothly drawn in the operation chamber 27, and the volumetric efficiency is increased. In addition, pulsation of a discharged fluid due to the above volume variations is suppressed, and hence a smooth operation can be realized.

In the embodiment, the sealed case 10 is set at a high pressure (discharge pressure). However, since both the ends of the cylinder 15 supported by the bearings 17*a* and 17*b* are set at the discharge pressure, i.e., the same pressure as that in the case 10, no sealing is required between the inner surface of the cylinder 15 on both the ends thereof and the bearings 17*a* and 17*b*.

Figure 4:
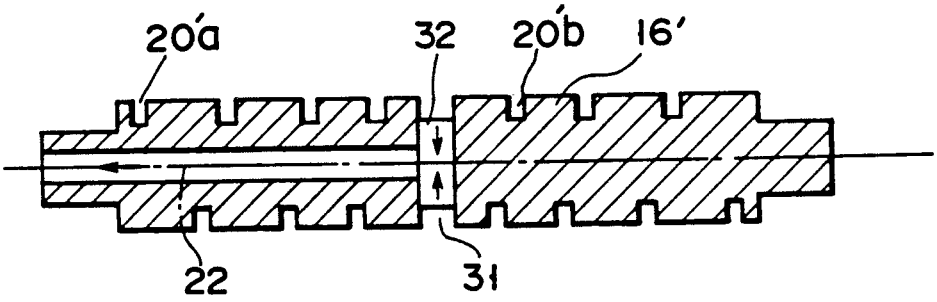
FIG. 4 is a sectional view showing a piston section according to a second embodiment of the present invention.

A main part of another embodiment of the present invention using a piston replacing the piston 16 in FIG. 1 will be described below. FIG. 4 is a sectional view showing a piston 16′ used in the second embodiment of the present invention. In contrast to the pitches of the helical grooves in the first embodiment, the pitches of helical grooves 20*a*′ and 20*b*′ of the piston 16′ are gradually decreased from both the ends to the central portion along the longitudinal direction. Referring to FIG. 1, in this case, the left and right end portions of an operation chamber 27 respectively communicate with suction ports through hollow portions 28*a* and 28*b* respectively formed in bearings 17*a* and 17*b*. In addition, the central portion of the operation chamber 27 communicates with a discharge port through a groove 31, a discharge opening 32, and a hollow portion 22 in the piston 16′ (see dotted arrows in FIG. 1).

FIGS. 5A to 5D show an operation of a compressing section of the second embodiment. Similar to FIGS. 3A to 3D, FIG. 5A shows a state wherein a cylinder 15 and the piston 16′ are located at a predetermined position (a rotation angle of 0°), and FIGS. 5B to 5D respectively show states wherein the cylinder 15 and the piston 16′ are rotated through 90°, 280°, and 270° with respect to the state shown in FIG. 5A. It is apparent that the same effects as those in the first embodiment can be obtained in this embodiment.

Figure 6:
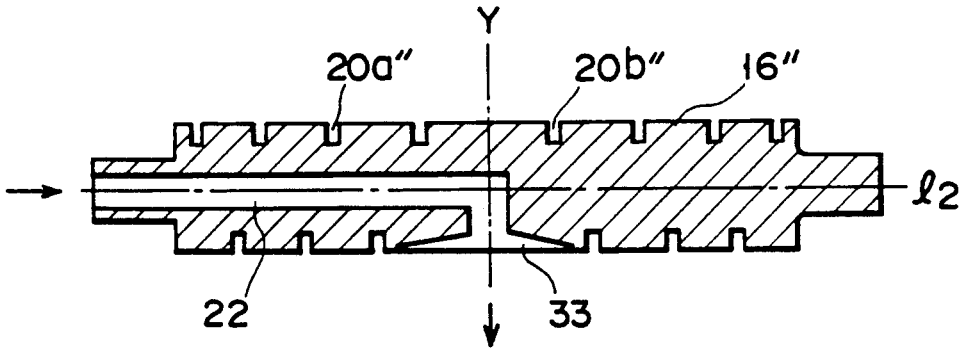
FIG. 6 is a sectional view showing a piston section according to a third embodiment of the present invention.

FIG. 6 is a sectional view showing a piston 16″ used for a third embodiment of the present invention. The piston 16″ is different from the piston of the first embodiment in that helical grooves 20*a*″ and 20*b*″ are symmetrical with each other and a large suction opening 33 communicating with a suction port is formed in the central portion of the piston in a direction Y perpendicular to a control axis l2. FIGS. 7A to 7D show an operation of a compressing section in the third embodiment. Similar to FIGS. 3A to 3D and FIGS. 5A to 5D, FIG. 7A shows a state wherein a cylinder 15 and the piston 16″ are located a predetermined position (a rotation angle of 0°), and FIGS. 7B to 7D respectively show states wherein the cylinder 15 and the piston 16'' are rotated through 90°, 180°, and 270° with respect to the state shown in FIG. 7A.

Figure 8:
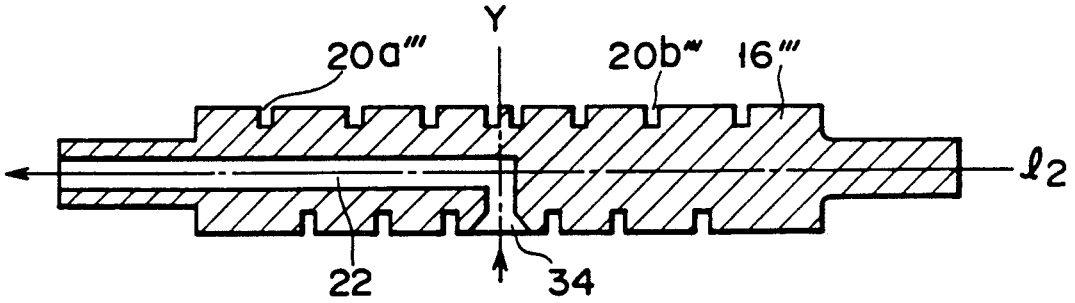
FIG. 8 is a sectional view showing a piston section according to a fourth embodiment of the present invention.
Figure 7A:
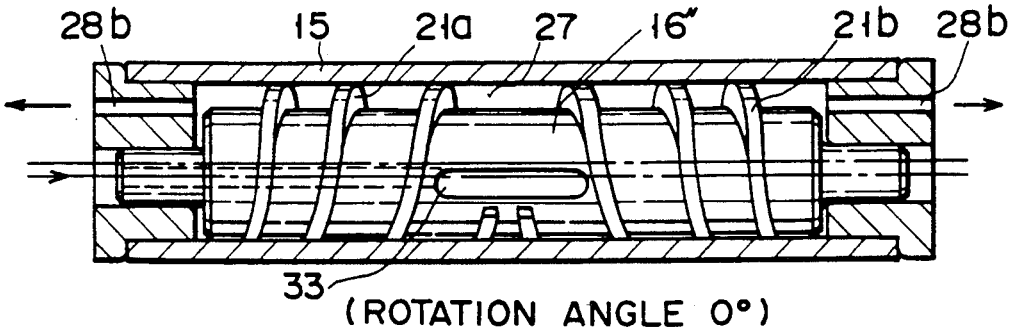
FIGS. 7A to 7D are sectional views showing an operation process of a compressing section of the third embodiment.
Figure 7B:
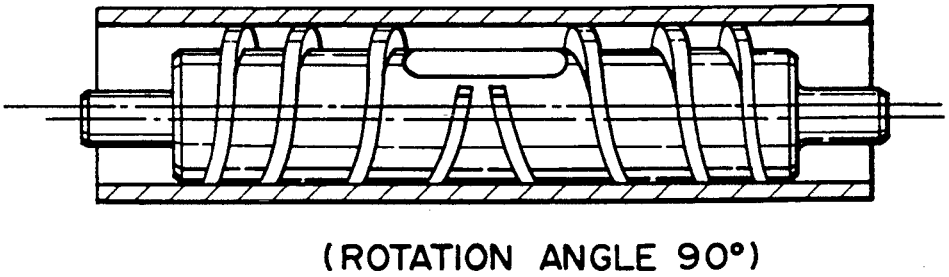
Figure 7C:
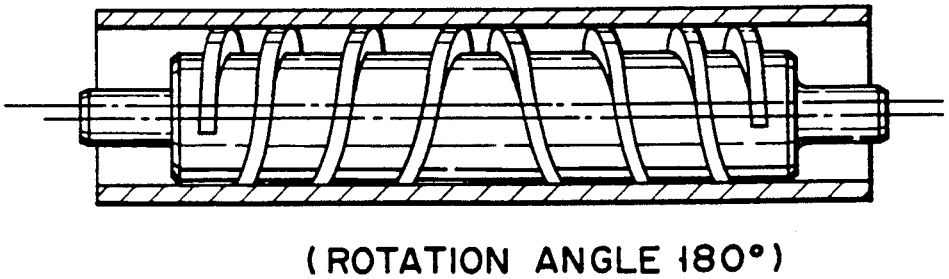
Figure 7D:
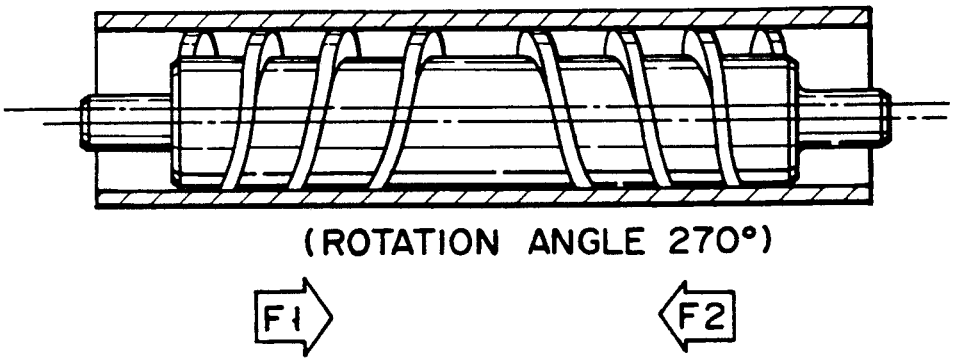
Figure 9A:
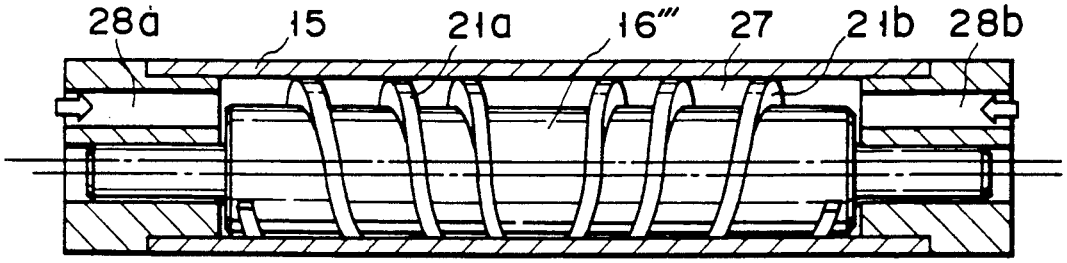
FIGS. 9A to 9D are sectional views showing an operation process of a compressing section of the fourth embodiment.
Figure 9B:
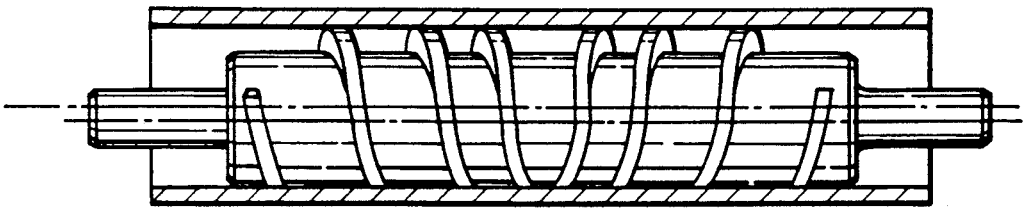
Figure 9C:
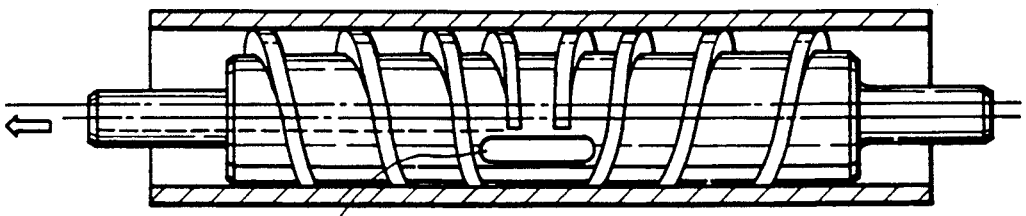
Figure 9D:
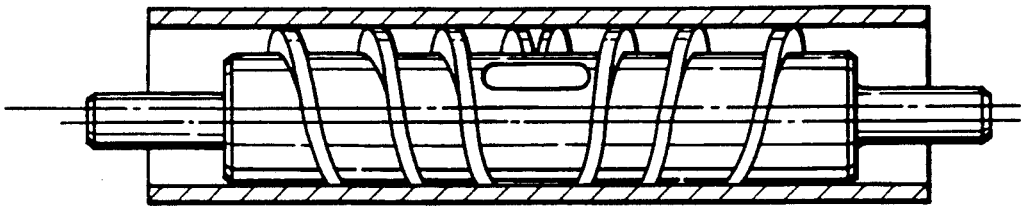
Figure 9D:
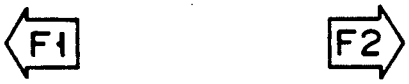

FIG. 8 is a sectional view showing a piston 16''' used for a fourth embodiment of the present invention. In contrast to the pitches of the helical grooves in the third embodiment, the pitches of helical grooves 20a''' and 20b''' the piston 16''' are gradually decreased from both the ends to the central portion along the longitudinal direction. In this case, the right and left ends of an operation chamber 27 respectively communicate with suction ports, and the operation chamber 27 is caused to communicate with a discharge port from a discharge port 34 formed in the central portion of the piston 16''' in the direction Y through a hollow portion 22. FIGS. 9A to 9D show an operation of a compressing section in the fourth embodiment. Similar to FIGS. 3A to 3D, FIGS. 5A to 5D, and FIGS. 7A to 7D, FIG. 9A shows a state wherein a cylinder 15 and the piston 16''' are located at a predetermined position (a rotation angle of 0°), and FIGS. 9B to 8D respectively show states wherein the cylinder 15 and the piston 16''' are rotated through 90°, 180°, and 270° with respect the state shown in FIG. 9A.

In the third and fourth embodiments, the same effects as in the first and second embodiments can be obtained in terms of a decrease in thrust loss and slide loss.

As described above, the first and third embodiments can be suitably applied to a case wherein the pressure (discharge pressure) in a sealed case is high, thereas the second and fourth embodiments can be suitably applied to a case wherein the pressure (suction pressure) in a sealed case is low. If the two types are selected depending on the pressure in a case in this manner, no sealing is required between a cylinder and bearings.

As has been described above, according to the present invention, in a helical blade type compressor, a thrust loss due to the difference in pressure between the suction and discharge sides can be decreased, and the efficiency of the compressor can be increased. In addition, a slide loss can be decreased and the reliability can be increased by reducing deformation/distortion of a blade. The present invention is very advantageous, especially, in terms of efficiency. For example, a thrust loss corresponding to 10 W occurring in a conventional compressor having a low input of about 100 W can be effectively decreased.

The present invention is not limited to the above-described embodiments. Various modifications and changes can be made within the spirit and scope of the invention.

For example, a high-pressure lubricating oil or gas may be introduced into the space defined between a helical groove and the edge of a blade in the respective embodiments so as to ensure a smooth operation of moving the blade in and out of the groove and prevention of a fluid leak between the respective operation chambers.

In addition, a motor section may be arranged to be horizontal along the cylinder axis instead of being arranged in a direction perpendicular thereto so as to decrease the height of the compressor.

What is claimed is:

1. A helical blade type compressor comprising:

a cylinder;

a piston eccentrically arranged in said cylinder along an axial direction thereof so as to be rotated relative to said cylinder while a part of said piston is in contact with an inner surface of said cylinder, said piston having first and second helical grooves formed in an outer surface thereof and separated at a central portion thereof, pitches of said first and second helical grooves being gradually increased from both end portions to the central portion of said piston;

first and second blades, respectively inserted in said first and second helical grooves of said piston so as to be moved in and out of said grooves and having outer edges helically brought into contact with said inner surface of said cylinder, for partitioning a space between the inner surface of the cylinder and the outer surface of said piston into a plurality of operation chambers, volumes of the plurality of operation chambers corresponding to the gradual pitch increase;

fluid introducing means having a hollow portion formed in said piston along the axial direction thereof and between at least one end portion of the piston and a central portion of the piston, for introducing a fluid to be compressed into a large-volume operation chamber of the plurality of operation chambers, which corresponds to the central portion of said piston;

driving means for causing the fluid introduced into the large-volume operation chamber to branch into the operation chambers constituting two channels whose volumes are gradually decreased toward both the end portions of said piston and sequentially supplying the fluid by rotating said piston relative to said cylinder, said driving means including a motor section for rotating said cylinder, transmitting means for transmitting a rotational force of said cylinder to said piston and first and second bearings for rotatably supporting both end portions of said cylinder and both end portions of said piston;

fluid extracting means for extracting a compressed fluid obtained by causing the fluid to branch into the operation chambers of the two channels and sequentially supplying the fluid; and a sealed case for housing at least said cylinder, said driving means and said fluid extracting means, and for storing a compressed fluid which is extracted by said extracting means therein;

wherein said motor section includes a stator fixed in said sealed case and a rotor arranged inward from said stator, said rotor being fixed to an intermediate portion of said cylinder.

2. A compressor according to claim 1, wherein said fluid extracting means comprises a discharge port formed in at least one of said first and second bearings.

3. A compressor according to claim 1, wherein said first and second blades are respectively inserted in said first and second helical grooves in such a manner that end portions of said first and second blades opposing the central portion of said piston define a predetermined phase angle.

4. A compressor according to claim 3, wherein the predetermined phase angle is 180°.

5. A compressor according to claim 3, wherein when the predetermined phase angle is 0°, the first and second blades are inserted to be symmetrical with each other along a longitudinal direction of said piston.

6. A compressor according to claim 5, wherein a large suction opening is formed in the central portion of said piston in a direction perpendicular to the axial direction thereof.

7. A compressor according to claim 1, said compressor further comprising:

a sealed case for housing at least said cylinder, said driving means, and said fluid extracting means in a sealed state; and discharge means for discharging a compressed fluid, which is stored in said sealed case by said fluid extracting means, outside said case.

8. A compressor according to claim 1, wherein said motor section comprises a rotor fixed to an outer surface of said cylinder and a stator opposing said rotor.

9. A helical blade type compressor comprising:

a cylinder;

a piston eccentrically arranged in said cylinder along an axial direction thereof so as to be rotated relative to said cylinder while a part of said piston is in contact with an inner surface of said cylinder, said piston having first and second helical grooves formed in an outer surface thereof and separated at a central portion thereof, pitches of said first and second helical grooves being gradually decreased from both end portions to the central portion of said piston;

first and second blades, respectively inserted in said first and second helical grooves of said piston so as to be moved in and out of said grooves and having outer edges helically brought into contact with said inner surface of said cylinder, for partitioning a space between the inner surface of said cylinder and the outer surface of said piston into a plurality of operation chambers, volumes of the plurality of operation chambers corresponding to the gradual pitch decrease;

fluid introducing means for introducing a fluid to be compressed into a large-volume operation chamber of the plurality of operation chambers, which corresponds to both the end portions of said piston;

driving means for causing the fluid introduced into the large-volume operation chamber to branch into the operation chambers constituting two channels whose volumes are gradually decreased toward both end portions of said piston and sequentially supplying the fluid by rotating said piston relative to said cylinder, said driving means including a motor section for rotation said cylinder, transmitting means for transmitting a rotational force of said cylinder to said first and second bearings for rotatably supporting both end portions of said cylinder and both portions of said piston;

fluid extracting means having a hollow portion formed in said piston along the axial direction thereof and between at least one end portion of said piston and a central portion of said piston, for extracting a compressed fluid, which is obtained by causing the fluid to branch into the operation chambers of the two channels and sequentially supplying the fluid, upon combining the branched fluids, at the central of said piston; and a sealed case for housing at least said cylinder, said driving means, and said fluid introducing means, and for storing the fluid to be compressed which is introduced by said introducing means;

wherein said motor section includes a stator fixed in said sealed case and a rotor disposed inward from said stator, said rotor being fixed to an intermediate portion of said cylinder.

10. A compressor according to claim 9, wherein said fluid introducing means comprises a suction port formed in at lest one of said first and second bearings.

11. A compressor according to claim 9, wherein said first and second blades are respectively inserted in said first and second helical grooves in such a manner that end portions of said first and second blades opposing both the end portions of said piston define a predetermined phase angle.

12. A compressor according to claim 11, wherein the predetermined phase angle is 180°.

13. A compressor according to claim 11, wherein when the predetermined phase angle is 0°, the first and second blades are inserted to be symmetrical with each other along, a longitudinal direction of said piston.

14. A compressor according to claim 13, wherein a discharge opening is formed in the central portion of said piston in a direction perpendicular to the axial direction thereof.

15. A compressor according to claim 9, wherein said driving means comprises a motor section for rotating said cylinder and transmitting means for transmitting a rotational force of said cylinder to said piston.

16. A compressor according to claim 15, wherein said motor section comprises a rotor fixed to an outer surface of said cylinder and a stator opposing said rotor.

* * * * *